United States Patent [19]

Takao

[11] Patent Number: 4,499,881

[45] Date of Patent: Feb. 19, 1985

[54] METHOD AND APPARATUS FOR CONTROLLING INTERNAL COMBUSTION ENGINES

[75] Inventor: Mitsunori Takao, Kariya, Japan

[73] Assignee: Nippondenso Co., Ltd., Kariya, Japan

[21] Appl. No.: 378,394

[22] Filed: May 14, 1982

[30] Foreign Application Priority Data

May 18, 1981 [JP] Japan ..... 56-74626

[51] Int. Cl.[3] ..... F02B 3/00

[52] U.S. Cl. ..... 123/492; 123/494

[58] Field of Search ..... 123/492, 491, 494

[56] References Cited

U.S. PATENT DOCUMENTS 3,548,791 12/1970 Long ..... 123/492

4,245,605 1/1981 Rice ..... 123/493

4,363,307 12/1982 Amano ..... 123/492

*Primary Examiner*—Ronald B. Cox

*Attorney, Agent, or Firm*—Cushman, Darby & Cushman

[57] ABSTRACT

In a method and an apparatus for controlling a quantity of fuel supplied to an internal combustion engine equipped with an electrically controlled fuel or air supply system, an amount of change of at least one controlling factor indicative of load conditions of the engine and a change in the predetermined amount of the change of the controlling factors obtained at sampling intervals are used to obtain data for correcting the controlling factors for controlling the quantity of fuel supplied to the engine, and the correction data is used to supply fuel to each engine cylinder without a delay with respect to a change in air supply to the cylinders even in a transitional state, thereby to attain accurate control of the engine.

8 Claims, 7 Drawing Figures

METHOD AND APPARATUS FOR CONTROLLING INTERNAL COMBUSTION ENGINES

BACKGROUND OF THE INVENTION

1. Field of the Invention

The present invention relates to the control of internal combustion engines and more particularly to a control method for an internal combustion engine equipped with an electronically controlled fuel injection system, which controls a quantity of fuel injected during a transitional period and an apparatus for performing that method.

2. Description of the Prior Art

In the past, it has been recognized that a quantity of fuel required for an engine during a transitional period differs from that required during a steady-state operation. Thus, with an engine equipped for example with a speed-density type electronic fuel injection system, a quantity of fuel injected during a transitional period is controlled by obtaining a quantity of change of an intake pipe pressure or a throttle position at intervals of a given time period so that when its value is greater than a predetermined value, a fuel injection quantity correction factor predetermined with respect to an engine cooling water temperature or with respect to a cooling water temperature and an amount of change of controlling factors is obtained and a basic fuel injection quantity determined by an engine speed and an intake pipe pressure is corrected in accordance with the value of a correction factor. Since this prior art method of controlling a fuel injection quantity during a transitional period computes an amount of change by sampling the controlling factors at intervals of a given time period for obtaining an amount of change of the controlling factors, a desired correction factor for correcting a basic fuel injection quantity is obtained in accordance with the amount of change of the controlling factors which is delayed in time as compared with the amount of change of controlling factors obtained by continuously sampling the controlling factors or the actual amount of change of the controlling factors. As a result, the correction of the fuel quantity cannot follow up or respond to the change of the actual air flow to the engine cylinders and thus the air-fuel ratio within the cylinders becomes lean causing the engine to backfire or become unsteady during the transitional period, particularly at a low temperature of the engine cooling water.

SUMMARY OF THE INVENTION

In order to obviate the foregoing drawbacks in the prior art, it is the primary object of the invention to provide a control method and an apparatus for internal combustion engines, which samples controlling factors at intervals of a given time period, corrects an amount of change of the controlling factors by a change in the amount of change of the controlling factors at the sampling intervals to obtain the amount of change of the controlling factors corrected to greatly reduce its delay with respect to the actual amount of change of the controlling factors and controls a quantity of fuel injected during a transitional period in accordance with the value of the corrected amount of change of the controlling factors, thereby satisfactorily controlling the engine even at a low temperature of the engine cooling water.

Thus, the present invention has a feature that in an engine equipped with an electronically controlled type fuel system controlling apparatus such as an electronically controlled type fuel injection controlling apparatus or electronically controlled type carburator controlling apparatus, an amount of change of at least one of controlling factors indicative of the loaded condition of the engine and a change in the amount of change of the controlling factors at the sampling intervals are utilized for obtaining a data for correcting the controlling factors used for controlling the engine.

DESCRIPTION OF THE PREFERRED EMBODIMENT

The present invention will now be described in greater detail with reference to the illustrated embodiment.

Figure 1:
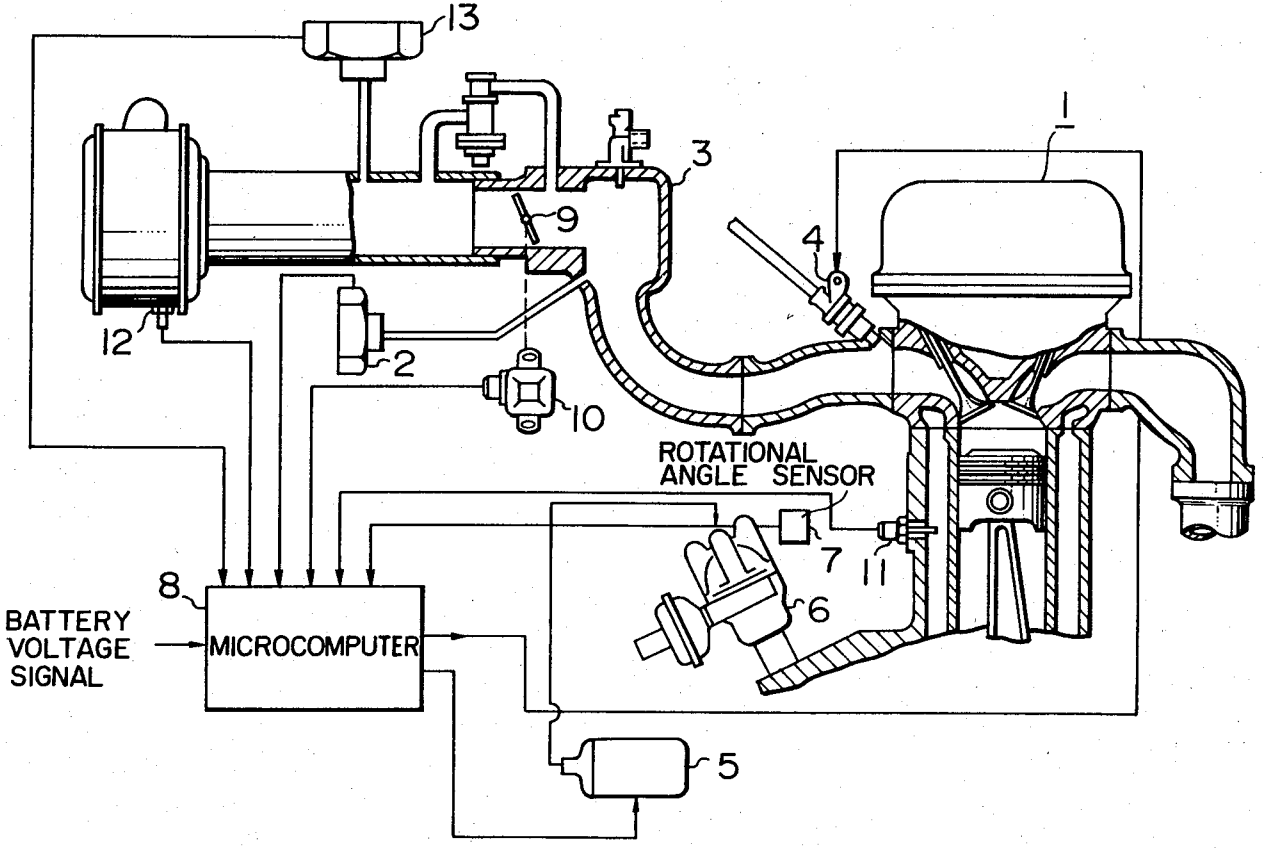
FIG. 1 is a schematic diagram showing the construction of a six-cylinder type engine and its control system to which a control method according to the present invention is applied.

In the FIG. 1, numeral 2 designates a semiconductor type intake pressure sensor for sensing the intake pressure of an intake manifold 3, and 4 an electromagnetic fuel injection valve positioned in the intake manifold 3 near the intake ports of the respective cylinders, and the fuel adjusted to a predetermined pressure is supplied to the valves 4. Numeral 5 designates an ignition coil which forms a part of the engine ignition system, and 6 a distributor for distributing the ignition energy produced by the ignition coil 5 to the respective spark plugs. The distributor 6 is of the known type which is rotated once for every two revolutions of the engine crankshaft and equipped with a rotational angle sensor 7.

Numeral 9 designates a throttle valve of the engine 1, and 10 a throttle sensor for sensing the position of the throttle valve 9. Numeral 11 designates a cooling water temperature sensor for sensing the warming-up condition of the engine 1, and 12 an intake air temperature sensor for sensing an intake air temperature.

Numeral 8 designates a microcomputer for computing the magnitude and timings of control signals for controlling the engine 1, and the signals from the intake pressure sensor 2, the rotational angle sensor 7, the throttle sensor 10, the cooling water temperature sensor 11 and the intake air temperature sensor 12 and a battery voltage signal are applied to the microcomputer 8 which in turn computes a quantity of fuel to be injected into the engine 1 from the fuel injection valves 4 and the timing of ignition of the engine 1 in accordance with the input signals. Numeral 13 designates an atmospheric pressure sensor for sensing the atmospheric pressure.

Figure 2:
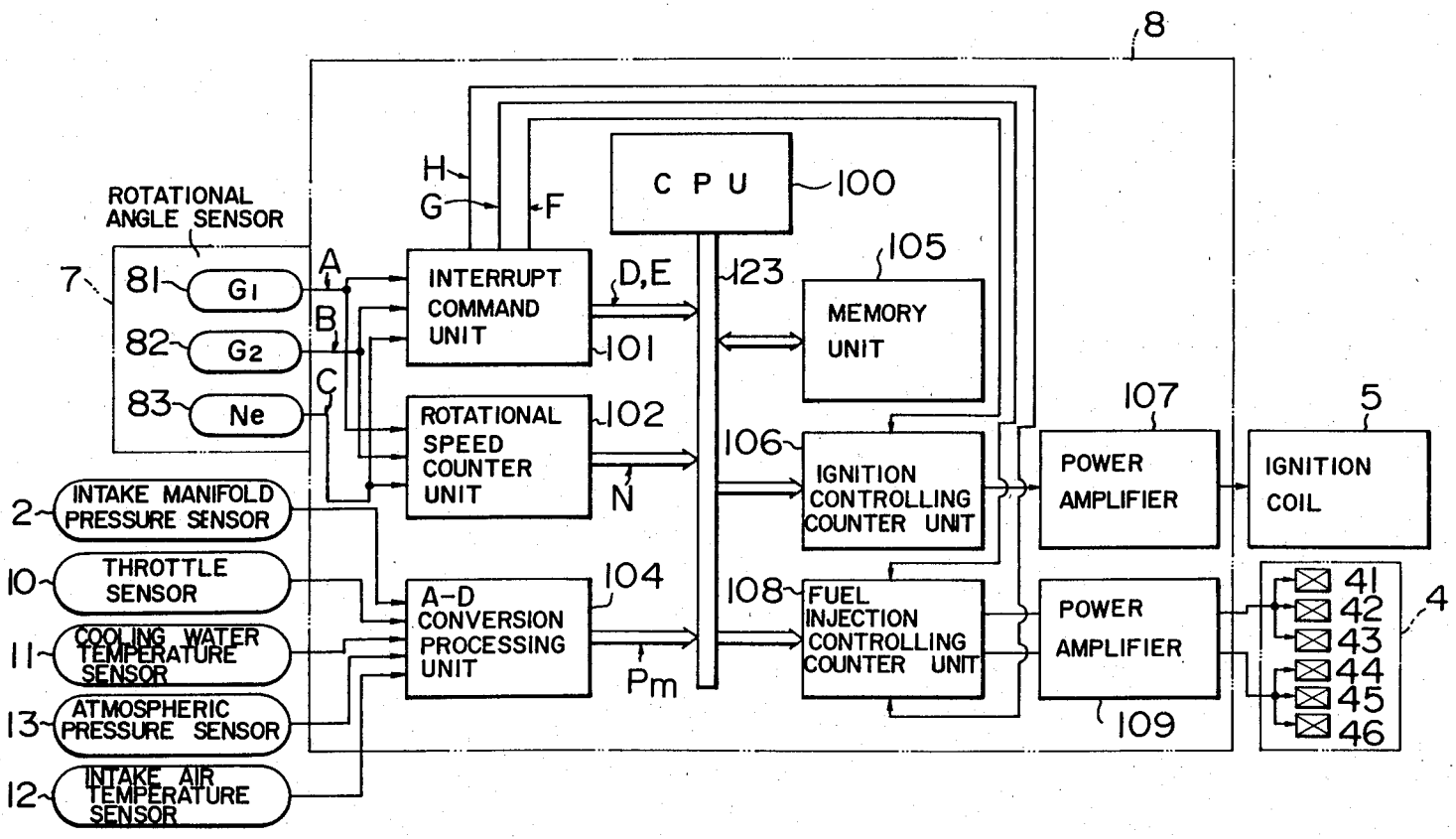
FIG. 2 is a block diagram for explaining in detail the construction of a control apparatus including a microcomputer, which is used in the control method according to the present invention.

In the FIG. 2, numeral 100 designates a central processing unit (CPU) for executing the computation of a fuel injection quantity and an ignition timings in response to interruptions. Numeral 101 designates an interrupt command unit responsive to the rotational angle signals from the rotational angle sensor 7 to interrupt the CPU 100 to cause it to execute the computation of a fuel injection quantity and an ignition timing and the transmission of its data to the CPU 100 is carried out via a common bus 123. Also the interrupt command unit 101 generates timing signals for controlling the operation starting timer of units 106 and 108 which will be described later. Numeral 102 designates a rotational speed counter unit responsive to the rotational angle signal from the rotational angle sensor 7 and a clock signal of a predetermined frequency from the CPU 100 to count a period of predetermined rotational angle and compute an engine rotational speed. Numeral 104 designates an A-D conversion processing unit which serves the function of converting into digital signals the analog signals produced from the intake pressure sensor 2, the throttle sensor 10, the cooling water temperature sensor 11, the intake air temperature sensor 12 and the atmospheric pressure sensor 13 and read out the digital signals to be inputted into the CPU 100. The output data of the units 102 and 104 are transferred to the CPU 100 via the common bus 123.

Numeral 105 designates a memory unit, which including RAMs and ROMs, for storing the control program of the CPU 100 and serving the function of storing the output data produced from the units 101, 102 and 104, and the transmission of data between the memory unit 105 and the CPU 100 is executed via the common bus 123.

Numeral 106 designates an ignition controlling counter unit uncluding a register whereby a digital signal indicative of the time of energizing the ignition coil 5 and the timing for deenergizing the ignition coil 5 which are computed by the CPU 100 is converted as a period of time and a timing corresponding to an engine crank angle.

Numeral 107 designates a power amplifier for amplifying the output of the ignition controlling counter unit 106 to energize the ignition coil 5. Numeral 108 designates a fuel injection controlling counter unit including registers, which comprises two down counters of an identical function for respectively converting a digital signal indicative of the valve opening duration of the fuel injection valve 4 or the fuel injection quantity computed by the CPU 100 to a pulse signal having a pulse time width which provides the valve opening duration of the fuel injection valve 4. Numeral 109 designates a power amplifier supplied with a pulse signal from the counter unit 108 for amplifying and supplying an output signal to the fuel injection valve 4, and the amplifier 109 comprises two channels in correspondence with the construction of the counter unit 108.

Figure 3:
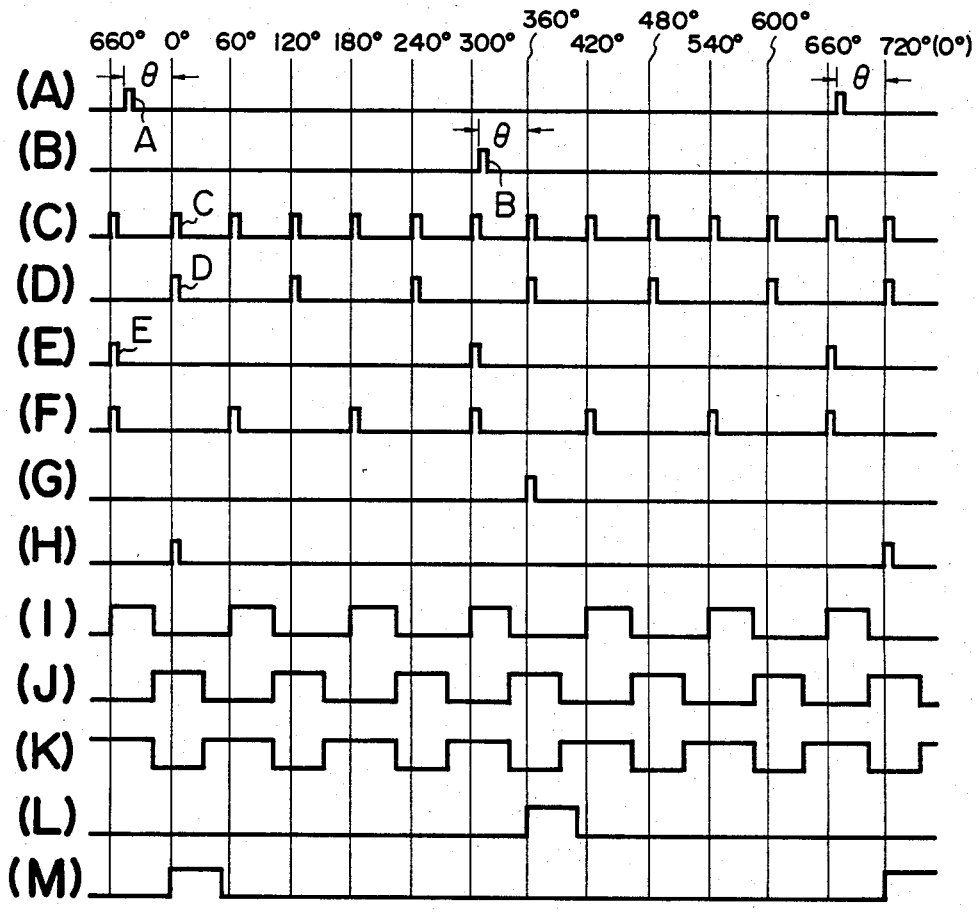
FIG. 3 shows a plurality of waveforms useful for explaining the operation of the control apparatus shown in FIG. 2.

As shown in FIG. 2, the rotational angle sensor 7 comprises three sensors 81, 82 and 83, and the first sensor 81 is constructed to generate an angle signal A at a position earlier by an angle $\theta$ than 0° crank angle once for every two revolutions of the engine crankshaft (or one revolution of the distributor 6) as shown by the waveform (A) in FIG. 3. The second sensor 82 is constructed to generate an angle signal B at a position earlier by the angle $\theta$ than 360° crank angle once for every two revolutions of the engine crankshaft as shown by the waveform (B) in FIG. 3. The third sensor 83 is constructed to generate the same number of angle signals as the number of the engine cylinders at equal intervals for every revolution of the crankshaft as shown by the waveform (C) in FIG. 3, that is, in the case of a six-cylinder type engine as the present embodiment six rotational angle signals are generated at intervals of 60° starting at 0° crank angle.

The interrupt command unit 101 receives the angle signals from the rotational angle sensors 81, 82 and 83 and generates an interrupt command signal for the computation of an ignition timing and an interrupt command signal for the computation of a fuel injection quantity. More specifically, a frequency of the angle signal C from the third sensor 83 is divided by 2, so that an interrupt command signal D is generated just after the generation of the angle signal A from the first sensor 81 as shown waveform (D) in FIG. 3. The interrupt command signal D is generated six times for every two revolutions of the crankshaft, i.e., the same number of the signals D as the engine cylinders are generated. Thus, in the case of the six-cylinder type engine the signal D is generated once for every 120° of crankshaft rotation to give an ignition timing interrupt command to the CPU 100. Also the interrupt command unit 101 divides a frequency of the signal from the third rotational angle sensor 83 by 6 so that an interrupt command signal E is generated once for every 360° of crankshaft rotation (one revolution) starting at the sixth angle signal C or at 300° crank angle after the generation of the angle signals from the rotational angle sensors 81 and 82 as shown by the waveform (E) in FIG. 3 and the interrupt command signal E gives an interruption to the CPU 100 for the computation of a fuel injection quantity.

Figure 4A:
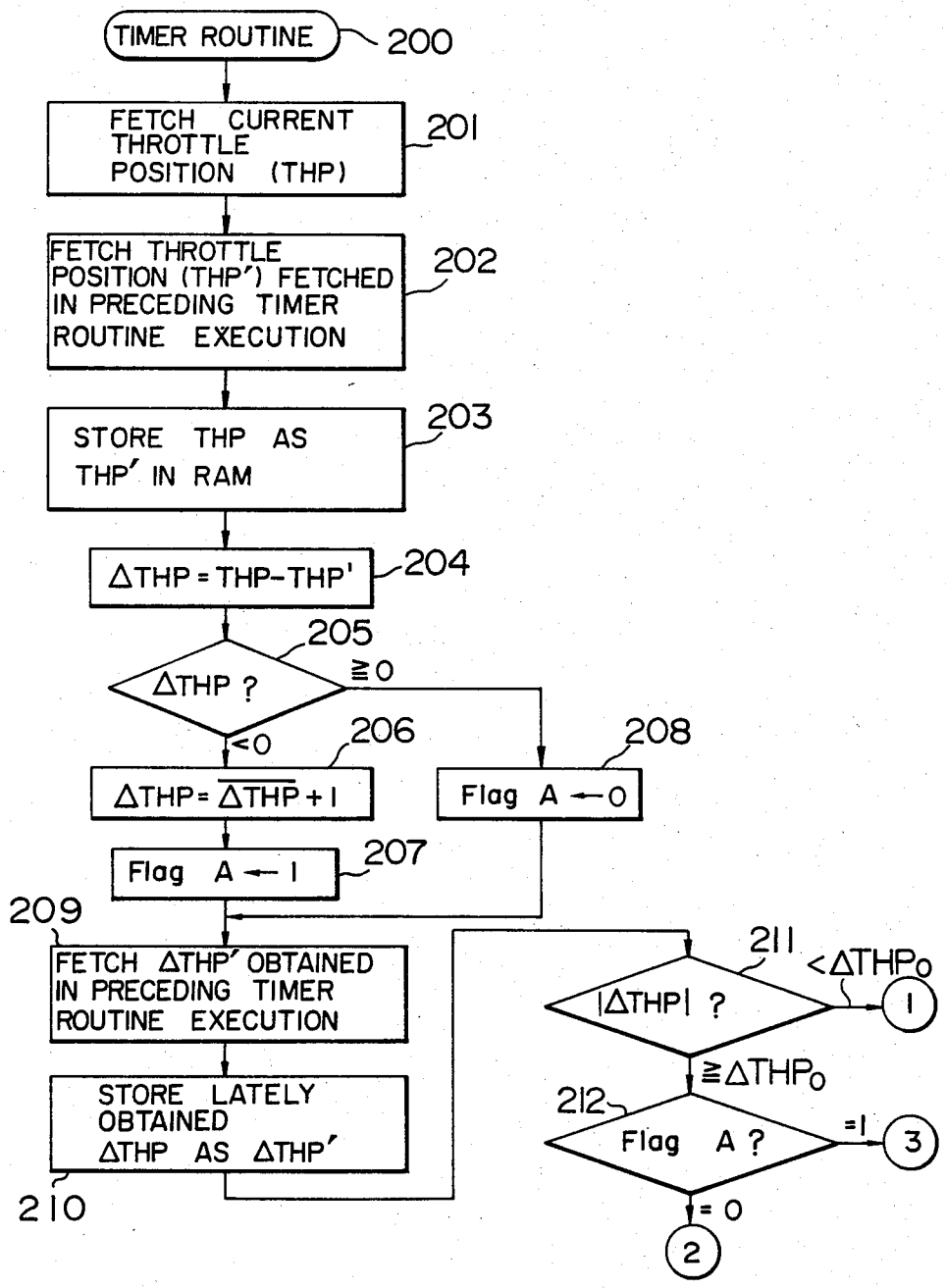
FIGS. 4(A) to 4(C) show a flow chart useful for explaining the operation of the control apparatus shown in FIG. 2.
Figure 4B:
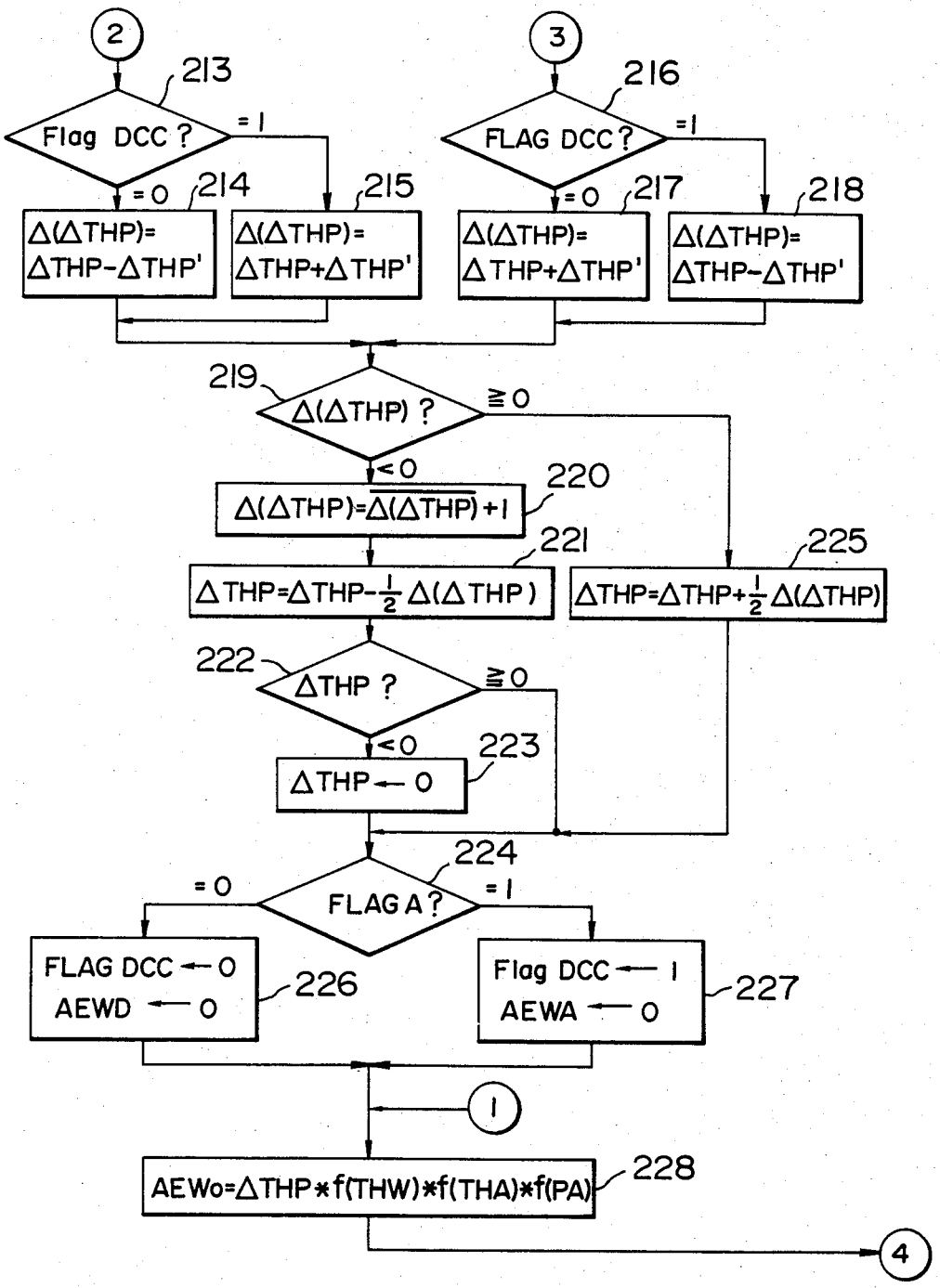
Figure 4C:
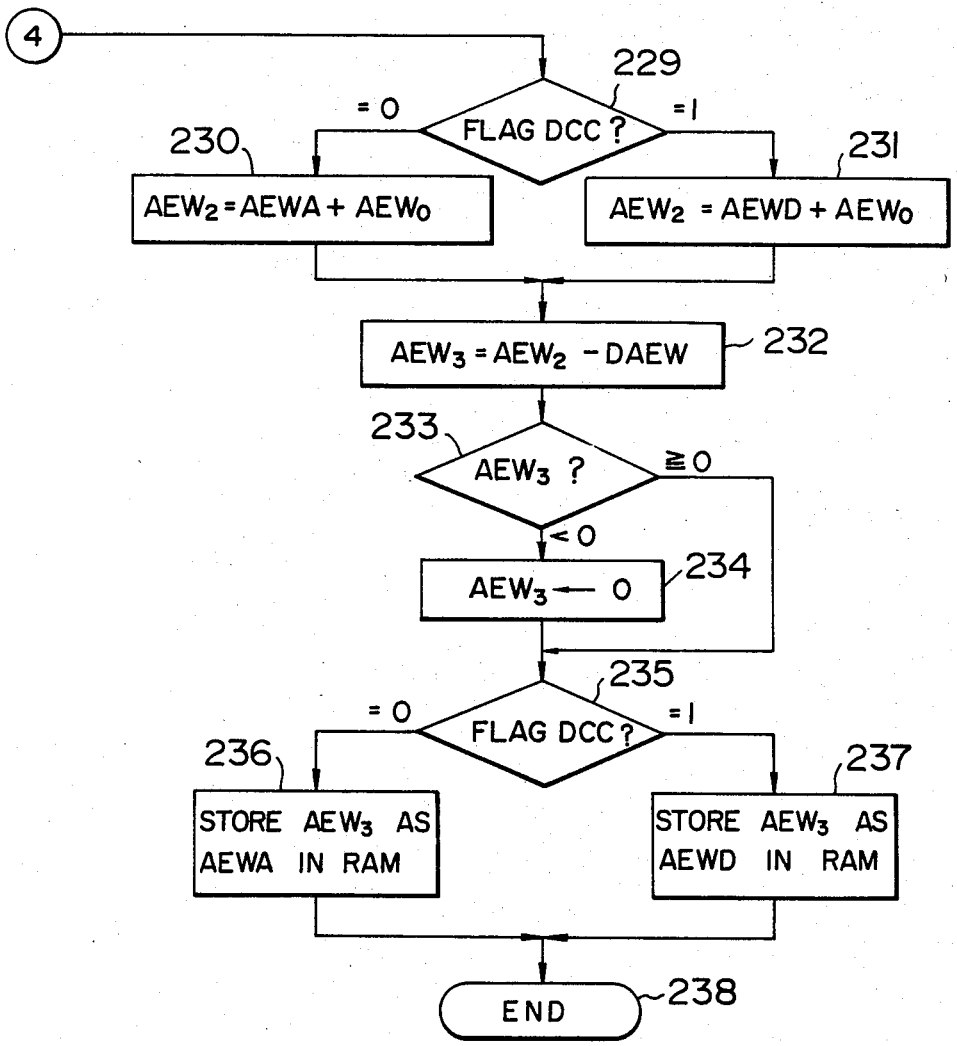

The operation of the apparatus shown in FIG. 2 will now be described with reference to the logical flow chart shown in FIGS. 4(A) to 4(C). The memory unit 105 stores a program such that a timer routine 200 is executed at intervals of a given time period even if a main routine is being executed by the CPU 100. With the processing of the timer routine 200, firstly a step 201 fetches the A-D converted value (THP) of the latest throttle position into the CPU 100 from the RAM, and a step 202 fetches from the RAM the throttle position (THP') fetched in the preceding execution of the timer routine. A step 203 stores the value THP as THP' in the RAM, and a step 204 computes THP-THP' to obtain ΔTHP. A step 205 decides as to whether ΔTHP is positive or negative. If ΔTHP is negative, the processing proceeds to a step 206 so that a 2's complement of ΔTHP is computed and a step 207 sets a logical flow control flag A to 1, thus advancing the processing to a step 209. If ΔTHP is positive or "0", a step 208 sets the flag A to "0" and then the processing proceeds to the step 209. The step 209 fetches a preceding amount of change ΔTHP' which was obtained by the preceding execution of the timer routine, and a step 210 stores the lately obtained ΔTHP as ΔTHP' in the RAM. A step 211 compares an absolute value of ΔTHP with a predetermined constant value $\Delta THP_0$. Thus, if $|\Delta THP| < \Delta THP_0$, the processing proceeds to a step 228. If $|\Delta THP| \geqq \Delta THP_0$, a step 212 examines the state of the flag A. If the flag A is "0", a step 213 examines the state of a flag DCC. If the flag DCC is "0", a step 214 computes THP-THP' to obtain a change in the amount of change Δ(ΔTHP). If the flag DCC is "1", the processing proceeds to a step 215 which in turn computes ΔTHP+ΔTHP' to obtain a different change in the amount of change $\Delta(\Delta THP)$. On the other hand, if the flag A is "1", the processing proceeds to a step 216 so that the similar operations as performed by the steps 213, 214 215 are performed by the steps 216, 217 and 218. A step 219 decides whether the value of $\Delta(\Delta THP)$ is positive or negative. If the value of $\Delta(\Delta THP)$ is negative, a step 220 computes the 2's complement of $\Delta(\Delta THP)$ and a step 221 computes $\Delta THP-\frac{1}{2}\Delta(\Delta THP)$ to obtain a new $\Delta THP$. A step 222 decides as to whether the $\Delta THP$ obtained by the step 221 is positive or negative. If $\Delta THP$ is negative, a step 223 sets $\Delta THP$ to "0". If $\Delta THP$ is positive or "0", the processing proceeds directly to a step 224. When the step 219 decides that $\Delta(\Delta THP)$ is positive or "0", a step 225 compute $\Delta THP+\frac{1}{2}\Delta(\Delta THP)$ to obtain a new $\Delta THP$ and then the processing proceeds to the step 224. The step 224 examines the state of the logical flow control flag A. If the flag A is "0", a step 226 sets the flag DCC to "0" and the value of AEWD stored in the RAM is set to "0".

If the flag A is "1", a step 227 sets the logical control flag DCC to "1" and the AEWA stored in the RAM is set to "0". A step 228 performs a cooling water temperature correction, an intake air temperature correction and an atmospheric pressure correction on $\Delta THP$ to obtain $AEW_0$. A step 229 examines the state of the flag DCC. If the flag DCC is "0", a step 230 obtains $AEW_2$ from $AEWA+AEW_0$. If the flag DCC is "1", a step 231 obtains $AEW_2$from $AEWD+AEW_0$. A step 232 subtracts a predetermined value DAEW from $AEW_2$ to obtain $AEW_3$, and a step 233 decides whether $AEW_3$ is positive or negative. If $AEW_3$ is negative, a step 234 sets $AEW_3$ to "0" and the processing proceeds to a step 235. On the other hand, if $AEW_3$ is positive or "0", the processing directly proceeds to the step 235 and the state of the flag DCC is examined. If the flag DCC is "0", this $AEW_3$ is stored as AEWA in the RAM,. If the flag DCC is "1", a step 237 stores the $AEW_3$ as AEWD in the RAM. A step 238 completes the processing of the timer routine and the processing of the main routine is resumed.

In accordance with the state of the flag DCC, a fuel injection duration computation routine provides a correction to increase or decrease a basic fuel injection duration ($T_P$) determined in accordance with the engine speed and the intake pressure. In other words, if the flag DCC is "0", the correction of $T_P$ is executed by $T_P*(1+AEWA)$. If the flag DCC is "1", the correction of $T_P$ is executed by $T_P*(1\text{-}AEWD)$.

Figure 5:
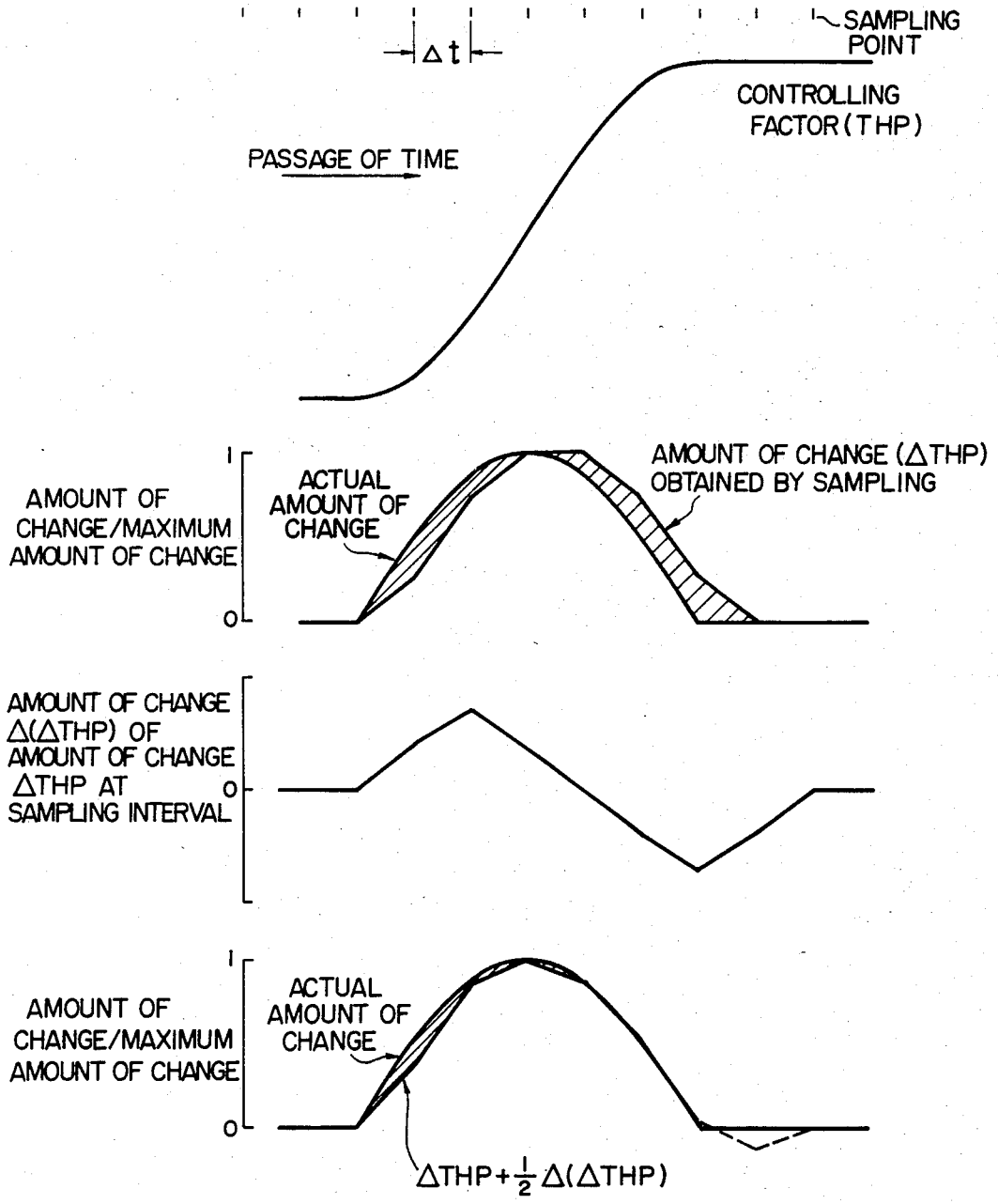
FIG. 5 is a diagram for explaining a method of correcting an amount of change of the controlling factors according to the present invention.

FIG. 5 shows that, if an amount of change of the controlling factors obtained by sampling it at intervals of a given time period is corrected in accordance with a rate change in the amount of change of the controlling factors at the sampling intervals, the delay from an actual amount of change of the controlling factors can be reduced considerably.

While, in the above-described embodiment, a correction factor for a fuel injection duration during a transitional period is obtained by means of the timer routine which is executed at intervals of a given time period, the computation of this correction factor may be effected by means of a routine which is executed at intervals of a given crank angle. Alternatively, the correction factor may be obtained by means of a routine which is for example synchronized with the computer processing which is neither executed at intervals of a given time period, e.g., at intervals of the throttle position A-D conversion period nor a given crank angle., Further, while, in the above-described embodiment, the present invention is applied to a six-cylinder type internal combustion engine equipped with a speed-density type electronically controlled fuel injection system, the present invention is not limited thereto, but the invention can be applied to other multi-cylinder type engines, e.g., four-cylinder or eight-cylinder type engines which are equipped with a mass flow type, throttle speed type or other type electronically controlled fuel injection system. Still further, while, in the embodiment described above, the present invention is applied to the control of internal combustion engines of the type equipped with an electronically controlled fuel injection system, the present invention is not limited thereto and the present invention can be applied to engines of the type equipped with an electronically controlled carburetor.

In accordance with the present invention, in an engine which is the control of an electronically controlled type fuel system, the fuel can be supplied to each engine cylinder without any delay to a change in the amount of air drawn into each engine cylinder even in a transitional state thereby controlling the engine accurately.

I claim:

1. A method of controlling a quantity of fuel supply to an internal combustion engine comprising the steps of:

(a) sampling at least one of controlling factors indicative of load conditions of said engine at intervals of a given period to obtain an incremental or decremental amount of change of said controlling factors;

(b) obtaining a change in the amount of change of said controlling factors at predetermined sampling intervals; and (c) obtaining data for correcting said controlling factors for controlling the quantity of fuel supply to said engine in accordance with the amount of change of said controlling factors and the change in the amount of change of said controlling factors.

2. A method according to claim 1, wherein said controlling factors indicative of the load conditions of said engine comprises a throttle position, an intake manifold pressure or an intake air quantity.

3. A method according to claim 1, wherein when a sign of a computed value obtained from the amount of change of said controlling factors and the change in the amount of change of said controlling factors becomes opposite to a sign of the amount of change of said controlling factors, said computed value is changed to zero.

4. A method according to claim 1, wherein a timer routine is executed at intervals of a predetermined time period during the execution of a main routine, and wherein during the execution of said timer routine an A-D converted value (THP) of a latest throttle position and a throttle position value (THP') fetched during the preceding execution of said timer routine are fetched to an RAM and a computation of THP−THP' is performed to obtain an amount of change $\Delta THP$.

5. A method according to claim 4, wherein said amount of change THP is subjected to an engine cooling water temperature correction, an intake air temperature correction and an atmospheric pressure correction to obtain a corrected amount of change AEWo.

6. A method according to claim 1, wherein when a fuel injection during computational routine is used to obtain a corrected fuel injection duration, a basic fuel injection duration (Tp) determined in accordance with a rotational speed and an intake manifold pressure of said engine is corrected to be increased or decreased by being multiplied by a correction factor which is determined in accordance with a state of a logical flow control flag where it becomes zero or "1", respectively.

7. An apparatus for controlling a quantity of fuel supply to an internal combustion engine, comprising:

(a) an intake pressure sensor for sensing a pressure in an intake manifold of said engine;

(b) a throttle sensor of sensing a position of a throttle valve of said engine;

(c) a cooling water temperature sensor for sensing a warming-up condition of said engine;

(d) an intake air temperature sensor for sensing a temperature of air supplied to said engine;

(e) a rotational angle sensor for sensing a rotational speed of said engine; and (f) a microcomputer responsive to output signals from said intake pressure sensor, said throttle sensor, said cooling water temperature sensor, said intake air temperature sensor and said rotational angle sensor for computing an amount of change of at least one of controlling factors indicative of load conditions of said engine and a change in the amount of change of said controlling factors at predetermined sampling intervals and generating a data for correcting controlling factors for controlling the quantity of fuel supply to said engine in accordance with the amount of change of said controlling factors and the change in the amount of change of said controlling factors.

8. An apparatus according to claim 7 further comprising an atmospheric pressure sensor for sensing atmospheric pressure, wherein said microcomputer comprises:

(a) a microprocessor unit;

(b) an interrupt command unit responsive to the output signals from said rotational angle sensor to command said microprocessor unit to perform interrupt processing for the computation of a fuel injection quantity;

(c) a rotational speed counter unit responsive to the output signals from said rotational angle sensor to count a period of a predetermined rotational angle in response to a clock signal of a predetermined frequency from said microprocessor unit and to compute a rotational speed of said engine;

(d) an A-D converter for converting analog output signals produced from said intake pressure sensor, said throttle sensor, said cooling water temperature sensor, said intake air temperature sensor and said atmospheric pressure sensor to digital signals and reading out the same to be transferred to said microprocessor unit;

(e) a memory unit for storing a control program of said microprocessor unit and output signals from said interrupt command unit, said rotational speed counter unit and said A-D converter, respectively;

(f) a fuel injection time controlling counter unit for converting a digital signal indicative of a valve opening duration of fuel injection valves of said engine, which is computed by said microcomputer, to a pulse signal having a pulse time width indicative of said valve opening duration of said fuel injection valves;

(g) a common bus adapted for the transmission of data between said interrupt command unit, said rotational speed counter unit, said A-D converter, said memory unit and said fuel injection time controlling counter unit and said microprocessor unit; and (h) a power amplifier for amplifying an output signal from said fuel injection time controlling counter unit and controlling said electromagnetically actuated fuel injection valves.

* * * * *